US008832908B2

(12) United States Patent
Koenigkramer et al.

(10) Patent No.: US 8,832,908 B2
(45) Date of Patent: Sep. 16, 2014

(54) ZIPPER WITH SACHET

(75) Inventors: Rusty Koenigkramer, Nanuet, NY (US); Robert Hogan, Burr Ridge, IL (US)

(73) Assignee: Illinois Tool Works Inc., Glenview, IL (US)

( * ) Notice: Subject to any disclaimer, the term of this patent is extended or adjusted under 35 U.S.C. 154(b) by 285 days.

(21) Appl. No.: 12/951,512

(22) Filed: Nov. 22, 2010

(65) Prior Publication Data

US 2011/0283487 A1 Nov. 24, 2011

Related U.S. Application Data

(60) Provisional application No. 61/297,330, filed on Jan. 22, 2010.

(51) Int. Cl.

| | |
|---|---|
| ***B65D 33/25*** | (2006.01) |
| ***B65D 81/18*** | (2006.01) |
| ***B65D 81/24*** | (2006.01) |
| ***B65D 81/20*** | (2006.01) |

(52) U.S. Cl.

CPC ..... *B65D 33/2541* (2013.01); *B65D 81/2084* (2013.01)

USPC ..... 24/399; 383/63

(58) Field of Classification Search

CPC ..... B65D 33/2541; B65D 81/2084

USPC ..... 24/399–402, DIG. 38, DIG. 39, DIG. 50, 24/DIG. 51; 353/63–65, 61.2

See application file for complete search history.

(56) References Cited

U.S. PATENT DOCUMENTS

| | | | | |
|---|---|---|---|---|
| 5,194,315 | A * | 3/1993 | Itoh | 428/178 |
| 5,686,161 | A | 11/1997 | Cullen et al. | |
| 5,744,246 | A * | 4/1998 | Ching | 428/474.4 |
| 5,766,706 | A | 6/1998 | Custer et al. | |
| 6,667,273 | B1 | 12/2003 | Cullen et al. | |
| 2006/0291756 | A1 | 12/2006 | Thomas et al. | |
| 2009/0067760 | A1 | 3/2009 | Shelley et al. | |

* cited by examiner

*Primary Examiner* — Jack W Lavinder

(74) *Attorney, Agent, or Firm* — McCarter & English, LLP

(57) ABSTRACT

A reclosable zipper is disclosed which includes a first profile containing a first interlocking element and a first product side flange. A second profile is provided which contains a second product side flange and a second interlocking element for reclosably interlocking with the first interlocking element. A sachet is provided on a flange either on the product or consumer side or extending between the first and second flanges.

8 Claims, 2 Drawing Sheets

ZIPPER WITH SACHET

CROSS-REFERENCE TO RELATED APPLICATIONS

This application claims priority to U.S. Provisional Patent Application No. 61/297,330, filed on Jan. 22, 2010, to Koenigkramer, the disclosure of which is incorporated herein in its entirety by reference.

BACKGROUND OF THE DISCLOSED EMBODIMENTS

1. Field of the Disclosed Embodiments

The disclosed embodiments relate to a reclosable zipper for a storage bag, where the zipper includes a sachet affixed to a flange of a zipper structure, either on the product or consumer side.

2. Description of the Related Art

Sachets are used in the food industry to affect the environment inside of a package or pouch by controlling for example moisture and humidity, gas concentrations, odors, liquid levels, depending on the absorptive characteristics of the sachet, where gases could include, for example, oxygen and ethylene, and the liquids could include, for example, water and blood. One typical example is an oxygen absorber sachet, utilizing known gas absorber chemistries, which is added to the package or pouch to extend shelf life of the product stored therein. Most sachets are provided for increasing product shelf life before opening, because once opened, the specific capacity of the sachet ingredients is exceeded by the expanded volume of air, humidity, etc., introduced and circulated within the pouch.

Typical sachets are loosely contained inside the package and concerns exist that a child will try to eat the sachet. In view of safety concerns, it is an object of the disclosed embodiments to attach a sachet to a zipper structure for a reclosable bag.

SUMMARY OF THE DISCLOSED EMBODIMENTS

The disclosed embodiments relate to a sachet or tea bag like or sandwich enclosure for chemistry typically stored in a sachet, depending on the environment to be regulated in the pouch, such as the amount of air included in the bag. More specifically, the disclosed embodiments relate to building a sachet into or onto a zipper flange. Accordingly, the disclosed embodiments relate to a reclosable zipper, which typically includes a first profile and a second profile with respective first and second interlocking elements, and a sachet provided either on a flange (product side or consumer side) or extending between adjacent flanges. As the sachet is attached to the zipper structure, and not loosely contained inside the package, concerns that a child will try to eat the sachet are minimized.

BRIEF DESCRIPTION OF THE FIGURES

Illustrating the disclosed embodiments are the attached figures, which are not to be considered as limiting, and in which.

DETAILED DESCRIPTION OF THE DISCLOSED EMBODIMENTS

Figure 1A:
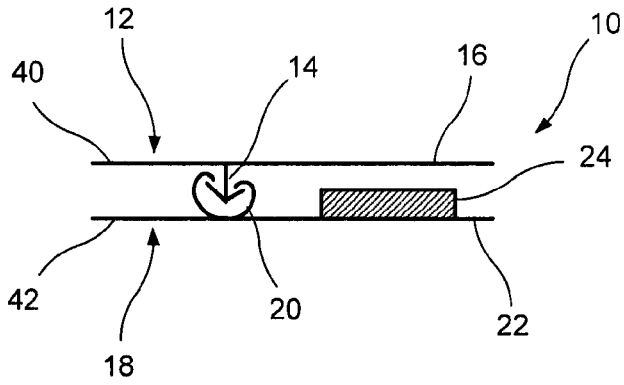
FIG. 1A is a side view of first and second zipper profiles which include a sachet on the second profile according to one disclosed embodiment.

Turning to FIG. 1A, a reclosable zipper 10 is illustrated. The zipper 10 includes a first profile 12 containing a first interlocking element 14 and a first product side flange 16 extending therefrom. A second profile 18 is illustrated which contains a second interlocking element 20 for reclosably interlocking with the first interlocking element 14. A second product side flange 22 on the second flange 18 is illustrated which extends from the second interlocking element 20. The first and second profiles 12, 18 are intended to be fixed to respective first and second bag panels (not illustrated), which are typically a polymeric film or web, where the profiles are fixed to the panels in a customary way to form a reclosable bag with a product side package or pouch.

A sachet 24 is illustrated which is connected to the second product side flange 22 (but may be attached on either the product or consumer side, the zipper 10 may oriented or reversed so that the flanges 16, 22 and the sachet 24 are on the consumer side). The sachet 24 extends adjacent to the second interlocking element 20, width-wise across the second profile 16, that is, in the width-wise direction for a bag. In this embodiment, the second profile 18 is integrally extruded and is used to form the sachet 24 thereby forming a unitary structure therewith. It is to be noted that the sachet 24 for each disclosed embodiment could be provided on the consumer side of the zipper rather than the product side flange 22.

The sachet 24 defines a compartment configured to contain material to affect environmental conditions within a bag, prolonging a shelf life of perishable items stored therein, as discussed above. Active ingredients in the sachet includes free flowing powdered chemistries like carbon, iron, salts, molecular sieves, etc. Smaller quantities of powders may be provided by continuous sprinkling whereas larger quantities of powders may be provided discontinuously in order to get a clean seal. Examples of oxygen scavenging systems can be iron filings plus two or three percent of a salt like sodium chloride in the presence of moisture in the pouch. As can be appreciated, iron scavenges oxygen by creating rust. U.S. Pat. No. 6,667,273, assigned to Multisorb Technologies, discloses a relatively more complex composition which releases carbon dioxide as it scavenges oxygen. The '273 patent discloses, for example, a formulated composition which includes by weight about 30% of particulate iron having about 2% of sodium chloride, about 19% of dry silica gel having less than about 3% moisture, about 18% of sodium bicarbonate, and about 33% fumaric acid. U.S. Pat. No. 5,686,161, also assigned to Multisorb Technologies, discloses an example of a moisture absorbing particulate silica gel. The '161 patent discloses, for example, that particulate can include desiccants or moisture adsorbents and absorbents, such as molecular sieve, zeolites, activated carbon, calcium oxide, calcium sulfate, Montmorillonite clay, suitable deliquescent salts, and the like. In addition, examples for ethylene gas absorption include potassium permanganate and zeolite crystals that absorb a variety of gases. These are just examples of ingredients for placement in the sachet 24. Any chemistry suitable for the sachet under a given set of conditions could be applied.

Each sachet disclosed herein is sealed about its perimeter, or folded over and sealed on three sides. With a low volume of powdered chemistry distributed over a wider area sachet, a tea bag style sachet could be sealed as a sandwich going through a pouch side seal. However if the sachet is provided with a high volume of powdered chemistry, the tea bag style sachet would need to be segmented so that it could be in registration to avoid side seal leaks.

Figure 1B:
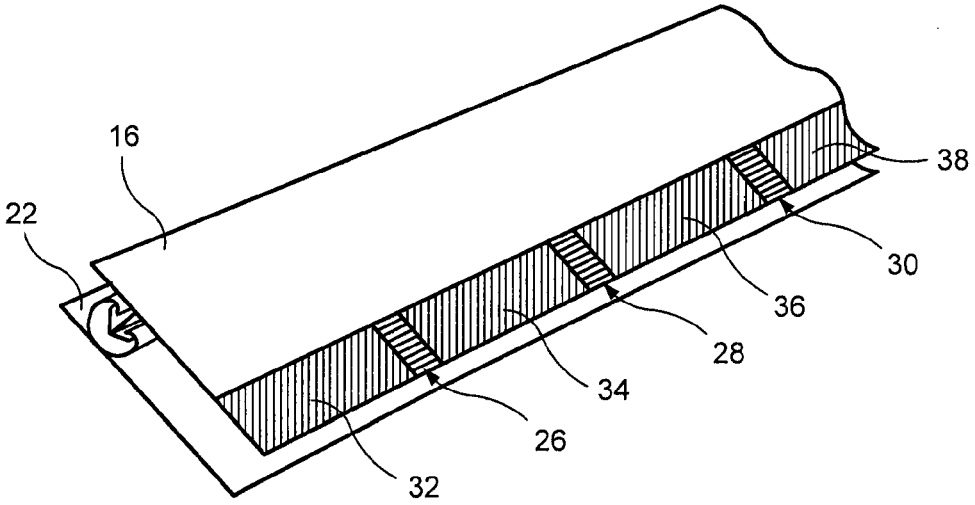
FIG. 1B is a perspective view of the first and second zipper profiles which include sachet segments on the second profile.

A segmented sachet is illustrated in FIG. 1B, where plural hard seals 26-30 are spaced width-wise along the sachet 24. The hard seals 26-30 extend along the height-wise span of the sachet 24, that is, in the height-wise direction for a bag, to form plural sachet segments 32-38. That is, as a result of the plural hard seals 26-30, the sachet 24 is segmented into the various smaller sachets 32-38. Each of the smaller sachets 32-38 is gas absorbing for controlling the environment in a bag package to which the zipper 10 is connected. In view of the segmenting of the sachets, the zipper would be in registration with the side seals during the manufacture of a reclosable package or bag or cut to length and applied across the film (which forms the package walls) in a transverse direction, that is, perpendicular to the machine direction of travel for the film during manufacture.

Preferably, the extruded flange 22 on the second profile 18 is gas permeable, or made so with the application of perforations, or by adding a breathable strip to form the bag. One example of a common fiberous synthetic material which is highly breathable but water tight is TyVek by DuPont. With such breathability, the sachet 24 would be capable of gas mitigation. For liquids, larger diameter requirements for effecting a migration path would include perforations. The migration rate can be relatively slow and span days or weeks and preferably would have the capacity to control the pouch environment for years, such as required with the Jerky food market. In addition, the product shelf life for almost any food which is sensitive to any specific gas could be improved with this type of configuration. Due to the increased efficiency of merging closure technologies and atmospheric modifier technologies, a cost savings would be realized.

As illustrated in FIG. 1A, the first and second product side flanges 16, 22 have a same height-wise span. However, in at least one alternative embodiment, disclosed below, the height-wise span differs between the product side flanges 16, 22.

One of the first and second interlocking elements 14, 20 is a male zipper component. On the other hand, another of the first and second interlocking elements 14, 20 is a female zipper component. In addition, the first profile 12 includes a first consumer side flange 40 extending from the first interlocking element 14. On the other hand, the second profile 18 includes a second consumer side flange 42 extending from the second interlocking element 20. The second consumer side flange 42 has a same height-wise span as the first consumer side flange 40. In the direction of the consumer side flanges 40, 42, a bag can include grips, ribs, one or more color lines, a double zipper, co-extrusions and/or other implements utilized on the consumer side of known reclosable bag configurations. Furthermore, the zipper is made of polymeric material, including, but not limited to, polypropylene and polyethylene. More specifically, possible materials include, but are not limited to, high density polyethylene, medium density polyethylene, low density polyethylene, linear low density polyethylene, polypropylene, cyclic olefin copolymers, ultra low density polyethylene, very low density polyethylene, elastomers, plastomers, metallocene linear low density polyethylene and metallocene polypropylene. It is noted that such terms as "high density", "medium density" and "low density" as used above are terms of art which would be understood by those skilled in the art.

Figure 2A:
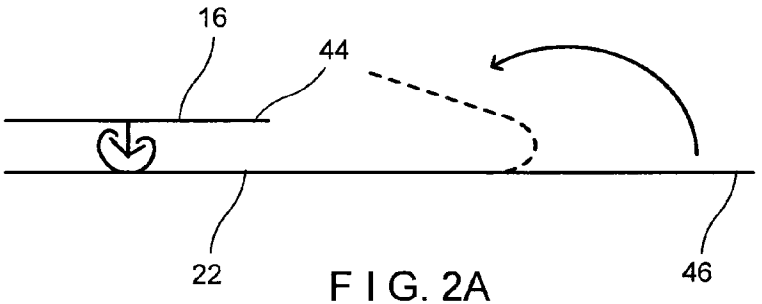
FIG. 2A is a side view of the first and second zipper profiles which are used in forming a sachet on the second profile according to a second disclosed embodiment.
Figure 2B:
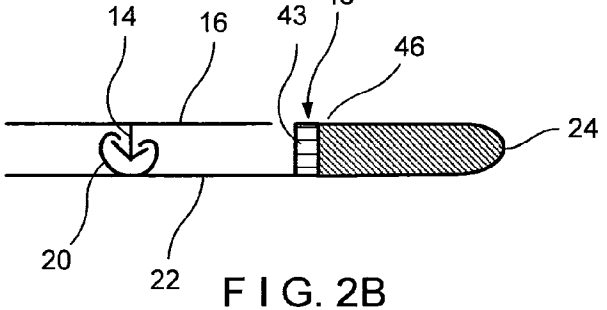
FIG. 2B is a side view of the first and second zipper profiles of FIG. 2A, which include a sachet formed on the second profile according to the second disclosed embodiment.

A second disclosed embodiment is illustrated in FIGS. 2A and 2B. In this embodiment, and in each additional embodiment disclosed herein, like elements of previously disclosed embodiments are represented by like reference numerals.

As identified in the illustrations for the second embodiment, the first product side flange 16 includes a first distal end 44. On the other hand, the second product side flange 22 includes a second distal end 46. For reasons which will become clear by review of the present disclosure, in this embodiment, the second product side flange 22 has a height-wise span which is greater than the first product side flange 16.

In the second embodiment, the sachet 24 is formed by returning or rolling the second distal end 46 of the second product side flange 22 towards the second interlocking element 20. The second distal end 46 is fixed, via a sachet seal 43, to the second product side flange 22. The location of the sachet seal 43 is at a position 48 spaced from the second interlocking element 20. Such spacing enables opening and closing of the zipper 10 without interference by the sachet 24. As provided in the illustration, the sachet seal 43 is a hard seal.

In addition, as with the first disclosed embodiment, plural hard seals 26-30 are spaced width-wise along the sachet 24, extending along the height-wise span of the sachet 24, to form the plural sachet segments 32-38. For example, in this embodiment, the powder material (typically free-flowing) of the sachet contents could be introduced. A powder material can be introduced at one end seal, where cross-seals and the second lengthwise seal completing the sachet. Moreover, as disclosed above, each of the sachet segments 32-38 is gas absorbing (and could likewise absorb small quantities of liquids).

Figure 3A:
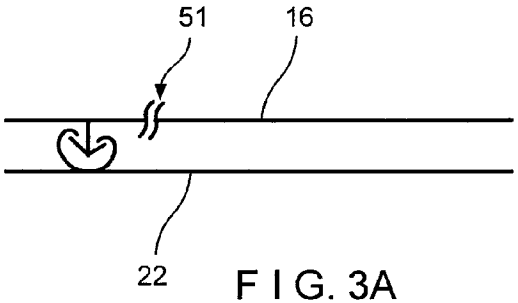
FIG. 3A is a side view of the first and second zipper profiles which are used in forming a sachet according to a third disclosed embodiment.
Figure 3B:
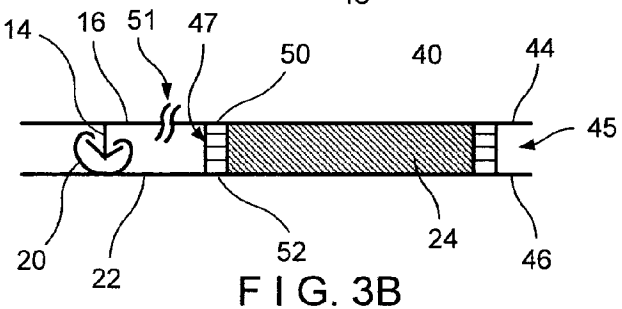
FIG. 3B is a side view of the first and second zipper profiles of FIG. 3A, which include a sachet formed therebetween according to the third disclosed embodiment.

Turning to FIGS. 3A and 3B, a third embodiment of the disclosure is illustrated. In this embodiment, the sachet 24 is formed by the first and second product side flanges 16, 22, between a distal end sachet seal 45 and an intermediate sachet seal 47. The distal sachet seal 45 is formed between the first distal end 44 on the first product side flange 16 and the second distal end 46 on the second product side flange 22. On the other hand, the intermediate sachet seal 47 is formed between a first intermediate position 50 on the first product side flange 16 and a second intermediate position 52 on the second product side flange 22. First and second interlocking elements 14, 20 can be extruded together, then slit from each other, possibly along a line of weakness, and then interlocked with each other.

For example, a pouch access line 51 representing the line of weakness is provided on first product side flange 16, between the interlocking member 14 and the intermediate sachet seal 50 (it should be noted that the sachet 24 could be on either the product or consumer side of either profile 12, 18). The pouch access line 51 could a slit, a tear line, a perforated line, or a laser score line. The access line 51 will separate to form an access opening when the bag is opened. This is because the first interlocking member 14 and portion of the first profile 12 above the access line 51 will pull away from the sachet 24 and the portion of the first profile 12 below the access line 51. Accordingly, in this embodiment, the pouch access line 51 facilities reclosable opening of a bag. It is to be appreciated that the pouch access line 51 does not extend in a bag height-wise direction to the bag panel (not shown) which is otherwise connected to the first profile 16. Instead, the bag panel would be connected above the pouch access line 51, closer to the first interlocking element 14 on the product side of the first profile 16.

As with the sachet seal 43 in the second embodiment, the intermediate sachet seal 47 in this embodiment is spaced from the first and second interlocking elements 14, 20. Furthermore, as with the sachet seal 43 in the second embodiment, the distal end sachet seal 45 and the intermediate sachet seal 47 are both hard seals. In addition, as with the first and second disclosed embodiments, plural hard seals 26-30 are spaced width-wise along the sachet 24, extending along the height-wise span of the sachet 24, to form the plural sachet segments 32-38. For example, in this embodiment, as with the third embodiment, sachet material could be introduced in batches of free-flowing material. Such a batch could be introduced at one end seal, where cross-seals and the second lengthwise seal completing the sachet. Moreover, as disclosed above, each of the sachet segments 32-38 is gas absorbing.

Figure 4A:
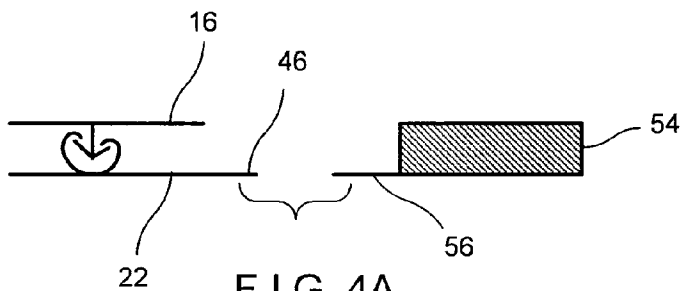
FIG. 4A is a side view of the first and second zipper profiles and a profile extension, which contains a sachet, and which is to be combined with the second profile, according to a fourth disclosed embodiment.
Figure 4B:
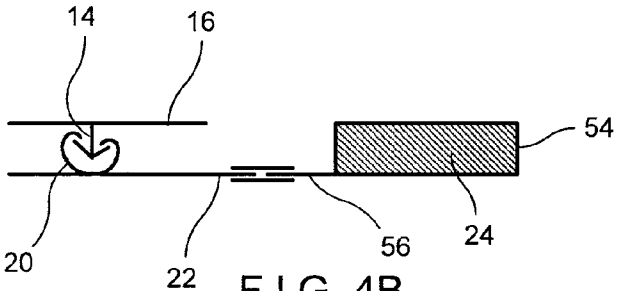
FIG. 4B is a side view of the first and second zipper profiles of FIG. 4A, which include a sachet connected to the second profile according to the fourth disclosed embodiment.

Turning to FIGS. 4A and 4B, a fourth embodiment is disclosed. In this embodiment, the zipper 10 includes a flange extension member 54 which is provided with the sachet 24. The flange extension member 54 includes a proximate end 56 which is connected to the distal end 46 of the second product side flange 22. As a result of this connection, the sachet 24 is connected to the second product side flange 22. In addition, the flange extension member 54 is hard sealed to the second product side flange 22.

As with the first disclosed embodiment, the flange extension member 54 is integrally extruded and then used to construct the sachet 24 thereby forming a unitary structure therewith. In addition, as with each of the above disclosed embodiments, plural hard seals 26-30 are spaced width-wise along the sachet 24, extending along the height-wise span of the sachet 24, to form the plural sachet segments 32-38. Further, in this embodiment, the sachet can comprise a set of pre-made, pre-filled sachets attached to the extension flange member 54. These pre-made sachets may be provided individually or in other forms, such as, but not limited to, ribbons. Moreover, as disclosed above, each of the sachet segments 32-38 is gas absorbing.

In addition, rather than providing a sachet 24 on an extension member 54, it is within the scope of the disclosed embodiments to seal, glue or otherwise attach a typical tea bag type sachet to one of the zipper flanges, such as one of the product side flanges 16, 22. In such an instance, the selected one of the product side flanges 16, 22 mated with the sachet 24 would act as a carrier for the sachet 24.

The present disclosed embodiments elements may be configured in other specific forms without departing from the spirit or essential characteristics identified herein. The described embodiments are in all respects only as illustrative and not as restrictive. The scope of the embodiments are, therefore, indicated by the appended claims and their combination in whole or in part rather than by the foregoing description. All changes that come within the meaning and range of equivalency of the claims are to be embraced within their scope.

We claim:

1. A reclosable zipper comprising:

a first profile containing a first interlocking element and a first product side flange extending therefrom;

a second profile containing a second interlocking element for reclosably interlocking with the first interlocking element, and a second product side flange extending therefrom; and a sachet connected to the second profile and extending adjacent to the second interlocking element, the sachet defining a plurality of segmented compartments separated by hard seals configured to contain and enclose material to affect environmental conditions within a bag.

2. The zipper of claim 1, where the sachet is connected to the first product side flange, the second product side flange, a first consumer side flange or a second consumer side flange.

3. The zipper of claim 2, where the second profile is integrally extruded and the sachet is formed thereon thereby forming a unitary structure therewith.

4. The zipper of claim 2, where plural hard seals are spaced width-wise along the sachet, and which extend along the height-wise span of the sachet, to form a plurality of discrete compartments as plural sachet segments.

5. The zipper of claim 2, where the first and second product side flanges have a same height-wise span.

6. The zipper of claim 2, where one of the first and second interlocking elements is a male zipper component and another of the first and second interlocking elements is a female zipper component.

7. The zipper of claim 2, wherein:

the first profile includes a first consumer side flange extending from the first interlocking element; and the second profile includes a second consumer side flange extending from the second interlocking element, which has a same height-wise span as the first consumer side flange.

8. The zipper of claim 1, wherein the second profile is capable of gas or liquid migration.

* * * * *